US005630626A

United States Patent [19]

Harper

[11] Patent Number: 5,630,626

[45] Date of Patent: May 20, 1997

[54] INFORMATION GUIDES

[75] Inventor: David Harper, Vancouver, Canada

[73] Assignee: InfoFlip Systems Corporation, Vancouver, Canada

[21] Appl. No.: 373,844

[22] Filed: Jan. 18, 1995

[51] Int. Cl.[6] ..... B42D 1/00

[52] U.S. Cl. ..... 281/38

[58] Field of Search ..... 402/79, 80; 281/31, 281/38, 44, 51, 15.1, 21.1, 22

[56] References Cited

U.S. PATENT DOCUMENTS 4,614,450 9/1986 Neiman ..... 402/79

4,964,656 10/1990 Prentice ..... 281/44

*Primary Examiner*—Willmon Fridie, Jr.

*Attorney, Agent, or Firm*—Townsend and Townsend and Crew LLP

[57] ABSTRACT

An information guide has leaves attached to a backing sheet along mutually spaced fold lines extending parallel to one another across the backing sheet, the leaves being turnable about the fold lines from first positions, in which they lie in mutually overlapping relationship on the backing sheet, through raised second positions, in which they extend upwardly from the backing sheet to third positions, in which they lie flat in another mutually overlapping relationship. An information text printed on the leaves has first text portions associated with first markings and second text portions which contain information related to corresponding ones of the first text portions, the second text portions being provided on marginal portions of the leaves which are exposed to view when the leaves are in the first positions. The user is visually directed, in a fast, non-confusing manner, by the first markings to the leaves bearing the associated second markings.

18 Claims, 4 Drawing Sheets

INFORMATION GUIDES

BACKGROUND OF THE INVENTION

1. Field of the Invention

The present invention relates to information guides and is useful, in particular, but not exclusively, for quick-reference booklets which may be employed, for example, to provide information relating to computer software or to any of a large variety of different subjects. Thus, the invention is useful, for example, for quick-reference software manuals.

2. Description of the Related Art

Information guides are generally provided in the form of books or other guides, which are usually provided with tables of contents and indexes for guiding the user to particular items of information, and the information text within such books may be divided, in a conventional manner, into chapters or other sections, each relating to a particular part of the subject matter of the book.

When it is desired to direct a reader from a first portion of the text of the book to a second portion, for example to obtain further and more detailed information with respect to the first portion, then it is usual to do so by directing the reader from a first page to the number of the page on which the second portion of information appears. The user is then required to hunt through the book until the relevant page is found, which may be a time-consuming and confusing operation, and may cause the user to lose the first page.

It is also well known to provide an index in the form of tabs at the right-hand sides of files and books, to facilitate the finding of information identified by the tabs. However, with this arrangement, the amount of space available on the tabs for identifying the items of information is usually very restricted and, with many tab arrangements, it is not possible to provide such information on the rear sides of the tabs.

BRIEF DESCRIPTION OF THE INVENTION

According to the present invention, there is provided an information guide which comprises a plurality of leaves secured to a backing sheet, along fold lines formed in the leaves, the fold lines being parallel to one another and spaced apart from one another and the leaves being turnable about the fold lines from first positions, in which the leaves lie in a mutually overlapping relationship on the backing sheet, to second positions, in which the leaves extend upwardly from the backing sheet. The leaves have information text on opposite sides of the leaves and also have marginal portions each having a first side which is exposed to view when the leaves are in the first positions and a second side which becomes exposed to viewer as the leaves are turned about the fold lines from the first positions to the second positions. Identifying markings on the marginal portions identify the subject matter of the information text appearing on respective ones of the leaves.

With this arrangement, the user can readily view the identifying markings on the first sides of the marginal portions of the leaves, when the leaves are in first positions and, therefore, can readily and immediately select one or more of the leaves to be turned about the fold lines from the first positions in order to expose the relevant portion of the information text. Subsequently, when some or all of the leaves have been turned in this way to the second positions, the identifying markings on the second sides of the marginal portions of the leaves can readily be viewed, for rapid and easy selection of another portion of the information text.

The identifying markings preferably comprise color coding and identifying text, corresponding color coding being provided in the information text, so that the reader can be readily referred, by the color coding in the information text, to an appropriate one of the marginal portions and, thus, to the portion of the information text identified by the identifying text in that marginal portion.

BRIEF DESCRIPTION OF THE DRAWINGS

Further features, objects and advantages of the present invention will be more readily apparent from the following description thereof when taken in conjunction with the accompanying drawings, in which.

DESCRIPTION OF THE PREFERRED EMBODIMENT

Figure 1:
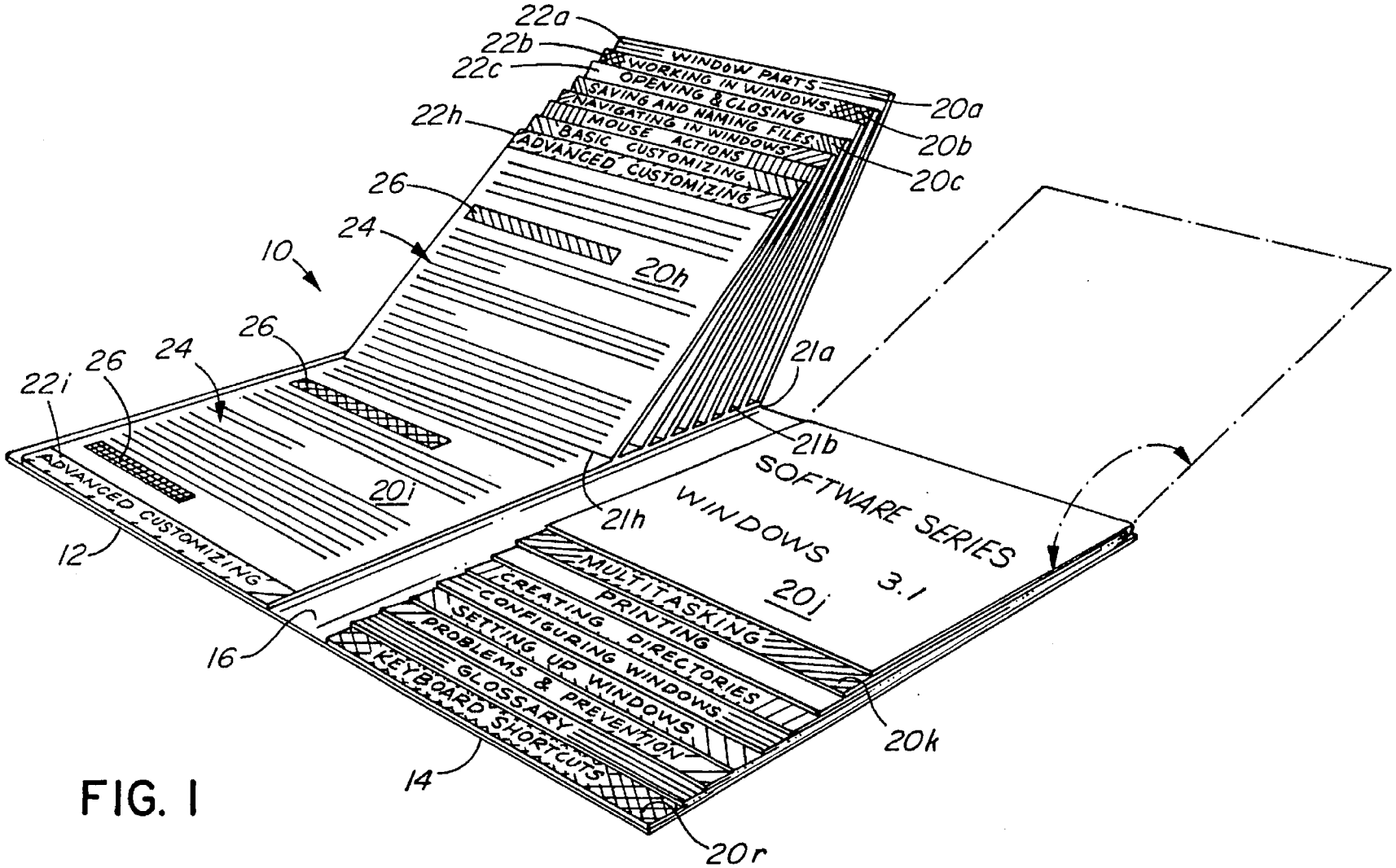
FIG. 1 shows an information guide according to the invention, in a partially opened condition, in a perspective view.

As shown in the drawings, an information guide in the form of a quick reference computer manual9 is indicated generally by reference numeral 10, and has a front cover 12, a rear cover 14 and an intermediate spine portion 16 connecting the front cover 12 to the rear cover 14.

The front cover 12 is provided with a set of leaves 20*a–i*, which are secured to the front cover 12 by an adhesive (not shown). The leaves 20*a–h* can be turned relative to the cover 12 about fold lines 21*a–h*, whereas the leaf 20*i* is secured by adhesive to the front cover 12.

The fold lines 21*a–h* are spaced apart from one another and are parallel to the top and bottom edges 19*a*, 19*b* of the front cover 12.

At their edges remote from the fold lines 21*a–h*, the leaves 20*a–h* have marginal portions 22*a–h* extending across the entire width of the leaves 20*a–h* and the leaf 20*i* likewise has a marginal portion 22*i* extending across the entire width of the leaf 20*i*. The leaves 20*a–h* are all of the same size. The fold lines 21*a–h* of adjacent pairs of the leaves 20*a–h* are spaced apart by a distance h1 (FIG. 2), measured transversely of the fold lines, which is equal to the height h2 of the marginal portions 22*a–j*. Consequently, when the leaves 20*a–h* are folded or turned downwardly onto the leaf 20*i*, so that the leaves 20*a–h* lie in a mutually overlapping shingled relationship on the cover 12, first or upper sides of the marginal portions 22*a–j* are exposed to view.

Figure 2:
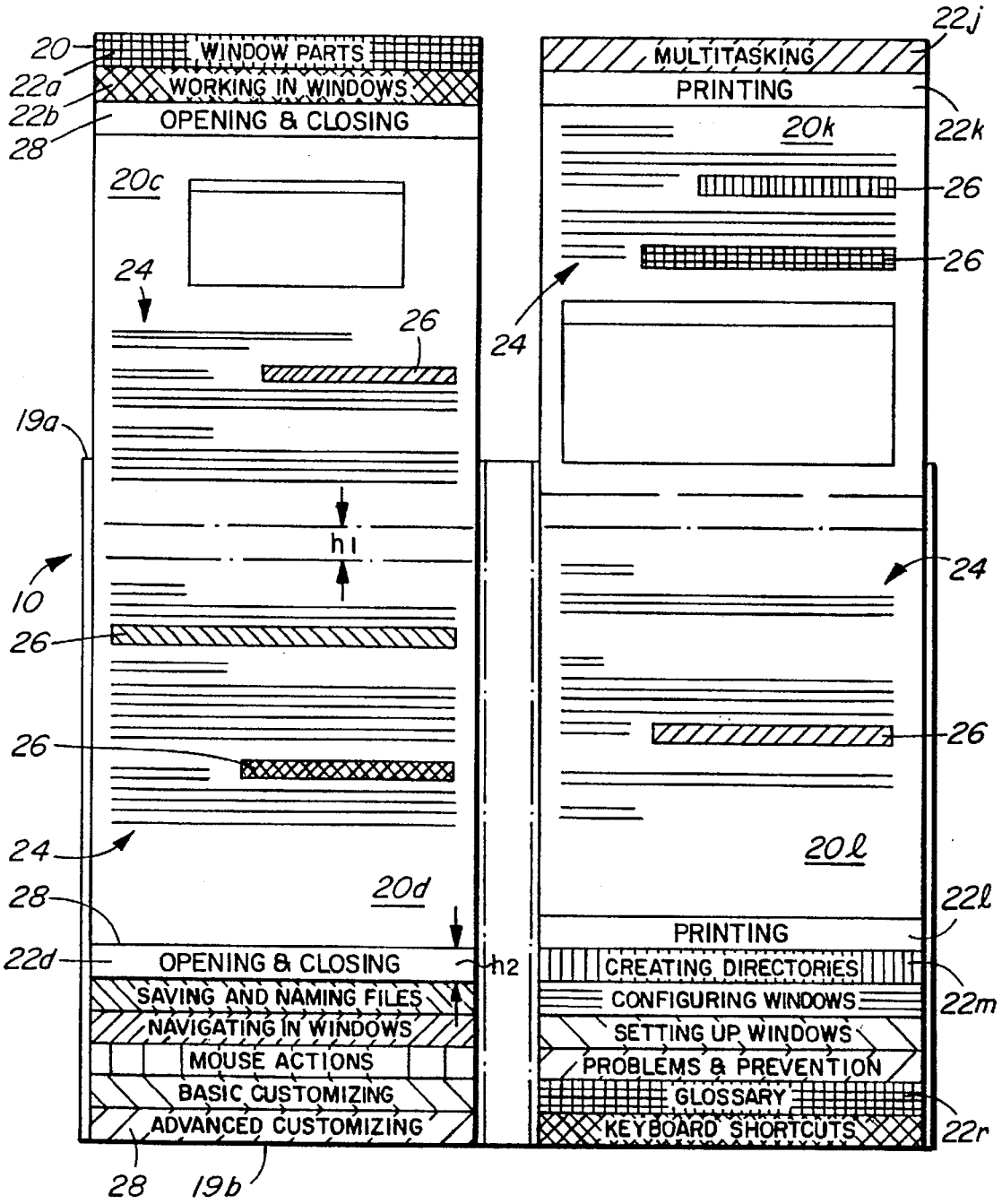
FIG. 2 shows a plan view of the information guide of FIG. 1 in an opened condition.
Figure 3:
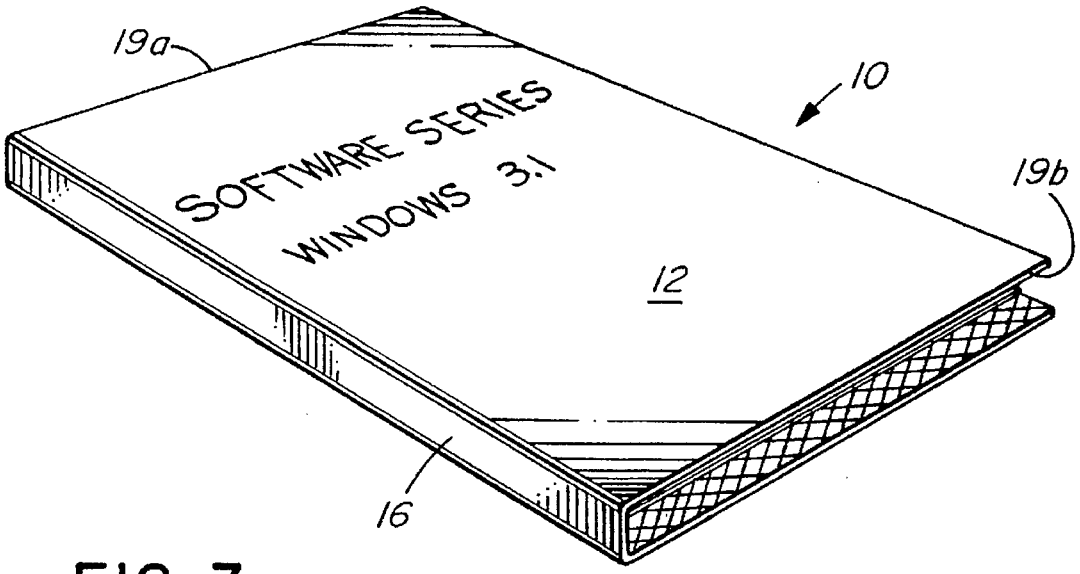
FIGS. 3 and 4 show two views in perspective of the information guide of FIGS. 1 and 2 in a closed condition.
Figure 4:
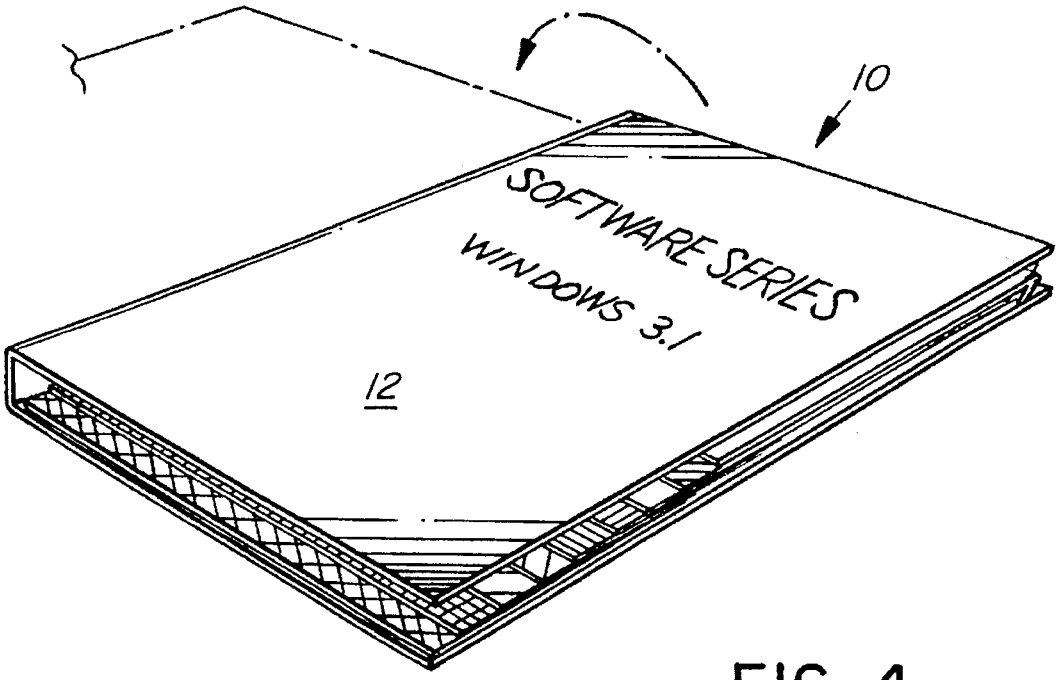

Thus, as shown in FIG. 2, in which the leaves 20*d–h* are shown in the first positions, the first or uppermost sides of the marginal portions in the first positions are all clearly visible to the user.

As the leaves 20*a–h* are turned relative to the cover 12 about their fold lines 21*a–h*, through slightly more than 90°, the opposite or second sides of the marginal portions 22*a–h* become exposed to view as illustrated in FIG. 1. As the leaves 20*a–h* are turned further in the same direction, they eventually come to lie in another mutually overlapping superimposed or shingled relationship substantially parallel to the cover 12, with the second sides of the marginal portions 22*a–h* fully exposed to view.

As shown in FIG. 2, the leaves 20*a–c* have been turned from their first positions into their second positions, while the leaves 20*d–h* remain in their first positions.

Information text, indicated generally by reference numeral 24, is printed on the opposite sides of the leaves 20*a–h* and on the uppermost side of the leaf 20*i*. In the information text 24, first portions of the text are enclosed in reference markings in the form of color blocks 26. The color blocks 26 and the marginal portions 22*a–j* of the leaves 20*a–i* are color coded, the arrangement being such that the color blocks 26 are associated with first portions of the information texts, and the marginal portions 22*a–i* are associated with second portions of the information texts which each provide further and more detailed information corresponding to the correspondingly colored first portions. Therefore, a user reading one of the first portions of the information text, and requiring further information relating to that first portion, can quickly and easily locate the correspondingly colored marginal portion 22*a–a* and, then, can raise the corresponding leaf 20*a–h* so as to reveal the appropriate second portion of the information text containing such additional information.

Figure 5:
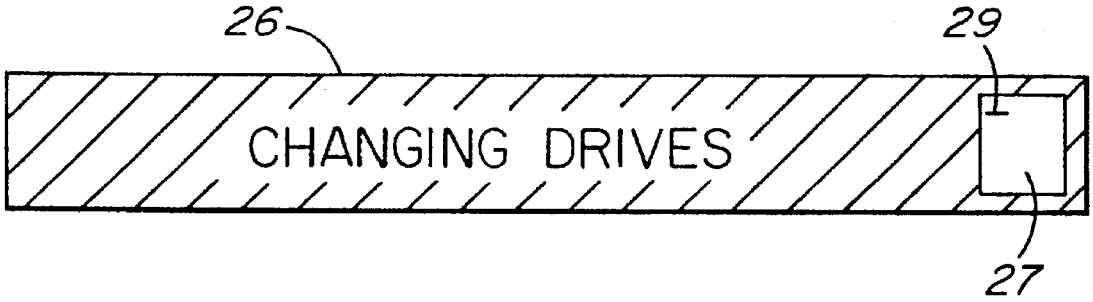
FIG. 5 shows and enlarged view of a color codes portion of information text.

More particularly, and with reference to FIG. 5, which shows one of the color blocks 26 in greater detail, it will be seen that the color block 26 includes, at its right-hand end, a rectangular blank space 27, with a marking in the form of a short horizontal line 29 projecting into the blank space 27 at the left-hand side of the blank space 27.

The purpose of the line 29 is to provide a visual indicator for guiding the user to the approximate location, on the corresponding leaf, of the required additional information. If the line 29 is positioned near the top of the blank space 27, then it indicates that the required additional information is near the top edge of the corresponding leaf. Likewise, if the line 29 is near the bottom of the blank space 27, then the required information is near the bottom edge of the corresponding leaf.

The marginal portions 22*a–a* are also provided with identifying texts 28, which identify the subject matter of the information text on the corresponding leaves. Thus, both the identifying texts 28 and, also, the color coding of the marginal portions 22*a–a* identify the subject matters of the associated portions of the information text 24. The identifying texts 28 thus serve as titles for the associated portions of the information text.

The color coding on the first sides of the marginal portions 22*a–h* comprises a set of different colors, and the color coding on the second sides of the marginal portions 22*a–h* comprises the same set of colors. The colors are arranged on the marginal portions so that a pair of such portions, each having the same color, are provided on mutually opposed sides of each adjacent pair of the leaves 20*a–i*. Thus, for example, referring to FIG. 2, it will be seen that the adjacent pair of leaves 20*c* and 20*d* have, on their mutually adjacent sides, the marginal portions 22*c* and 22*d* which have the same color and, also, which have the same identifying text 28, which in the present embodiment is the wording "OPENING AND CLOSING".

The rear cover 14 forms a backing sheet for a second set of leaves 20*j–r*, which are secured to the rear cover 14 in a manner similar to the above-described manner in which the leaves 20*a–a* are secured to the front cover 12. Likewise, the leaves 20*j–r* are provided with marginal portions 22*j–r*, which are color coded and which bear identifying texts 28 in a manner similar to the portions 22*a–i*.

As can be seen from FIG. 1, the uppermost side of the leaf 20*j*, when the leaf 20*j* is in its first position, in which it is shown in FIG. 1, has no color coded marginal portion, and the stone applies with respect to the leaf 20*a*.

Likewise, since the undersides of the leaf 20*i* and 20*r* are secured by adhesives to the covers 12 and 14 respectively, these undersides of these leaves are also not provided with any color coded marginal portions, identifying text or information text.

The color coding of the marginal portions 22*j–r* is different from that of the marginal portions 22*a–i*, so that the information text color coding 26 can be used to refer the user from one of the leaves 20*a–*20*h* to one of the leaves 20*j–*20*r* and vice versa.

As will be apparent from the above description, the present guide requires no page numbers, glossary, index or list of chapters. Further, the present guide does not require the user to begin at a first page and read further, as is customary with a conventional book, but readily enables the user to view immediately all of the identifying texts, before turning any one of them, and to select any of the leaves to commence reading of the information text.

As will be apparent to those skilled in the art, modifications may be made in the above-described information guide within the scope and spirit of the appended claims. For example, the guide may comprise a single set of leaves on a single backing sheet, or may comprise three or more sets, each on a respective backing sheet, with the backing sheets connected to one another. Also, while the fold lines extend from side to side across the backing sheets in the illustrated embodiment, they may alternatively extend from top to bottom of their backing sheets. The leaves need not be rectangular but may, for example, be hour-glass shaped or circular. The fold lines may be creased, scored, serrated or formed in any other suitable manner.

I claim:

1. An information guide, comprising;

a backing sheet;

a plurality of leaves attached to said backing sheet;

said leaves each having information text on opposite sides thereof, said information text including first text portions identified by color blocks of various colors;

said leaves having marginal portions on opposite sides thereof and said marginal portions being color coded with colors corresponding to those of said color blocks;

said information text including second text portions containing information related to corresponding ones of said first text portions and said second text portions being associated, by said color coding of said marginal portions, with said corresponding ones of said first text portions, so that a user is guided from any one of said first text portions to the associated one of said second text portions by the color coding; and said leaves being secured to said backing sheet along fold lines in said sheets and said fold lines being parallel to one another and spaced apart from one another to expose said marginal portions on one side thereof when leaves lie in mutually overlapping relationship on said backing sheet and on the opposite side thereof when any of said leaves is pivoted away from said backing sheet.

2. An information guide as claimed in claim 1, wherein said first text portions have visual indicator markings indicating the locations on the leaves, relative to top and bottom of said leaves, of the related second text portions.

3. An information guide as claimed in claim 1, in which said marginal portions include identifying texts indicating the information on the respective ones of said leaves.

4. An information guide as claimed in claim 1, wherein said fold lines extend parallel to top and bottom edges of said backing sheet and said marginal portions extend along edges of said leaves remote from said fold lines and parallel to said fold lines.

5. An information guide as claimed in claim 4, wherein said marginal portions extend across the entire widths of said leaves.

6. An information guide as claimed in claim 2, wherein said color blocks are provided on said first text portions and said visual indicator markings comprise blank spaces on said color blocks and markings positioned in said blank spaces in accordance with the locations of said second text portions on their respective leaves.

7. An information guide as claimed in claim 1, wherein said identifying markings are provided on opposite sides of said marginal portions of said leaves.

8. An information guide as claimed in claim 7, wherein said leaves are turnable through substantially 180', whereby the marginal portions on either side of said leaves can be exposed to view.

9. An information guide as claimed in claim 1, wherein said backing sheet comprises a front cover and a rear cover of said guide and wherein said leaves comprise a first set of leaves attached to said front cover and a second set of leaves attached to said rear cover.

10. An information guide, comprising;

a backing sheet;

a plurality of leaves attached to said backing sheet;

said leaves each having information on opposite sides thereof;

said information including first information portions identified by reference markings;

said leaves having marginal portions on opposite sides thereof and said marginal portions including identifying markings corresponding to said reference markings;

said information including second information portions containing information related to corresponding ones of said first information portions and said second information portions being associated, by said identifying markings and said reference markings, with said corresponding ones of said first information portions, so that a user is thereby guided from any one of said first information portions to the associated one of said second information portions; and said leaves being secured to said backing sheet along fold lines in said sheets and said fold lines being parallel to one another and spaced apart from one another to expose said marginal portions on one side thereof when leaves lie in mutually overlapping relationship on said backing sheet and on the opposite side thereof when any of said leaves is pivoted away from said backing sheet.

11. An information guide as claimed in claim 10, wherein said first portions have visual indicator markings indicating the locations on the leaves, relative to top and bottom edges of said leaves, of the related second portions.

12. An information guide as claimed in claim 10, in which said marginal portions include identifying texts indicating the information on the respective ones of said leaves.

13. An information guide as claimed in claim 10, wherein said fold lines extend parallel to top and bottom edges of said backing sheet and said marginal portions extend along edges of said leaves remote from said fold lines and parallel to said fold lines.

14. An information guide as claimed in claim 10, wherein said marginal portions extend across the entire widths: of said leaves.

15. An information guide as claimed in claim 11, wherein said identifying markings comprise color blocks provided on said first portions and said visual indicator markings comprise blank spaces on said color blocks and markings positioned in said blank spaces.

16. An information guide as claimed in claim 10, wherein said identifying markings are provided on opposite sides of said marginal portions of said leaves.

17. An information guide as claimed in claim 16, wherein said leaves are turnable through substantially 180', whereby the marginal portions on either side of said leaves can be exposed to view.

18. An information guide as claimed in claim 10, wherein said backing sheet comprises a front cover and a rear cover of said guide and wherein said leaves comprise a first set of leaves attached to said front cover and a second set of leaves attached to said rear cover.

* * * * *